US012245707B2

(12) United States Patent
Grove

(10) Patent No.: US 12,245,707 B2
(45) Date of Patent: Mar. 11, 2025

(54) THREE-DIMENSIONAL PERFORATED WALL MOUNTING SYSTEM

(71) Applicant: Wall Control, Inc., Tucker, GA (US)

(72) Inventor: Richard Joseph Grove, Loganville, GA (US)

(73) Assignee: Wall Control, Inc., Tucker, GA (US)

( * ) Notice: Subject to any disclaimer, the term of this patent is extended or adjusted under 35 U.S.C. 154(b) by 2 days.

(21) Appl. No.: 17/994,754

(22) Filed: Nov. 28, 2022

(65) Prior Publication Data

US 2023/0165389 A1 Jun. 1, 2023

Related U.S. Application Data

(60) Provisional application No. 63/283,814, filed on Nov. 29, 2021.

(51) Int. Cl.
*A47F 5/08* (2006.01)

(52) U.S. Cl.
CPC ..... *A47F 5/0815* (2013.01)

(58) Field of Classification Search
CPC ..... A47F 5/116; A47F 5/0815; A47F 5/0823; A47F 5/101
USPC ..... 248/174, 220.31, 300; 40/605, 606.01, 40/606.16, 606.17, 610
See application file for complete search history.

(56) References Cited

U.S. PATENT DOCUMENTS 1,090,142 A * 3/1914 Fischer ..... A47F 5/112 211/73
1,857,231 A * 5/1932 Allen ..... A47F 5/112 206/464
1,897,940 A * 2/1933 Leopold ..... A47F 7/18 248/174
3,449,848 A * 6/1969 Howell ..... G09F 15/0075 40/605
3,695,455 A * 10/1972 Larson ..... A47F 5/02 248/220.31
3,718,261 A * 2/1973 Woofter ..... B43M 99/008 248/152
4,353,179 A * 10/1982 Jennings ..... G09F 7/22 40/607.1
4,384,172 A * 5/1983 Knickerbocker ..... H04Q 1/14 361/829
4,608,773 A * 9/1986 White ..... G09F 15/0075 40/607.1
4,991,335 A * 2/1991 Krautsack ..... G09F 1/06 40/539
5,249,771 A * 10/1993 Wear ..... G09F 7/22 248/300
5,606,815 A * 3/1997 Feldwhere ..... G09F 15/0006 40/607.03

(Continued)

*Primary Examiner* — Eret C McNichols
*Assistant Examiner* — Michael McDuffie
(74) *Attorney, Agent, or Firm* — Johnson, Marcou, Isaacs & Nix, LLC

(57) ABSTRACT

A three-dimensional perforated-panel wall mounting system comprises multiple perforated panels mounted in a three-dimensional configuration, which increases the panel storage area for a corresponding two-dimensional mounting surface area. For example, perforated panels are attached to two sides of a triangular-shaped mounting bracket. When the third side of the mounting bracket is attached to a wall or other mounting surface, the system provides twice the perforated panel area compared to a surface area of the wall covered by the system.

16 Claims, 6 Drawing Sheets

(56) References Cited

U.S. PATENT DOCUMENTS

| | | | | |
|---|---|---|---|---|
| 6,073,782 | A * | 6/2000 | Ascik | A47F 7/021 206/774 |
| 7,047,681 | B2 * | 5/2006 | Perelli | E01F 9/654 116/63 P |
| 8,640,889 | B2 * | 2/2014 | Gasper | A47F 5/0823 211/74 |
| 9,217,581 | B1 * | 12/2015 | Merideth | F24F 13/32 |
| 2015/0265070 | A1 * | 9/2015 | Mestres Armengol | A47F 5/11 248/174 |
| 2015/0275446 | A1 * | 10/2015 | Rust | G09F 7/18 256/26 |
| 2020/0357314 | A1 * | 11/2020 | Milne | A47F 5/10 |
| 2023/0165389 | A1 * | 6/2023 | Grove | A47F 5/0815 248/220.31 |

* cited by examiner

THREE-DIMENSIONAL PERFORATED WALL MOUNTING SYSTEM

CROSS REFERENCE TO RELATED APPLICATIONS

This application claims priority to U.S. Provisional Patent Application No. 63/283,814 filed Nov. 29, 2021 and titled "Three-Dimensional Wall Mounting System." The entire contents of the above-identified priority application are hereby fully incorporated herein by reference.

TECHNICAL FIELD

The technology disclosed in this application relates to wall mounting systems and, more particularly, to three-dimensional wall mounting systems comprising perforated wall panels that extend outwardly from a wall.

BACKGROUND

Conventional wall storage systems include brackets, hooks, trays, shelves, or other storage or display components ("storage components") mounted to perforated storage panels that attach to a wall, workbench, or other two-dimensional surface. The panels have various configurations of holes and/or slots in the surface of the panels. The storage components mate with the holes/slots to attach to the panels. One common name for the perforated storage panels is "peg board."

Conventional mounting systems utilize flat storage panels that are mounted flat on a surface, for example, a wall, to be used for storage. Each panel may include an L-shaped flange, or other extension, such as a channel, along edges of the panel. In this manner, mounting the panel with the extension next to the wall results in the panel being disposed with a gap between a back surface of the panel and the wall. The panel also can be mounted to a full or partial frame attached to the wall to provide the gap between the back surface of the panel and the wall. In this manner, the storage components may be mated with the holes/slots on the panel without interference from the wall, as the storage components protrude through the holes/slots on a front surface of the panel to engage with and mount to the panel.

When mounted to a wall, work bench, or other surface, conventional flat storage panels provide a storage or display area ("storage area") that is directly proportional to the area of the panel, as the panel is mounted flat over the corresponding surface. Accordingly, the storage area of conventional panel configurations is limited to the available surface area of the wall on which the panel is flatly mounted.

A need exists to increase the storage or display area corresponding to a two-dimensional space available for mounting a storage or display panel.

DETAILED DESCRIPTION

The technology described herein relates to a three-dimensional wall mounting system. The system comprises multiple perforated storage panels mounted in a three-dimensional configuration, which increases the panel storage area for a corresponding two-dimensional mounting surface area.

A conventional 16"×32" perforated wall storage panel provides a panel storage area of 512 square inches when mounted flat on a surface. The two-dimensional wall surface (or other surface on which the flat panel is mounted) also has a corresponding area of 512 square inches. According to one example of the three-dimensional wall mounting system described herein, the single 16"×32" flat-mounted panel is replaced by two 16"×32" panels that occupy the same footprint on the wall. In this example, the panels are mounted in a three-dimensional, triangular configuration, where each panel forms one side of the triangle, and the mounting surface acts as a third side of the triangle. In this manner, the storage area is doubled compared to conventional mounting configurations (two panels are mounted in the same surface area space for one conventional panel configuration).

Figure 1:
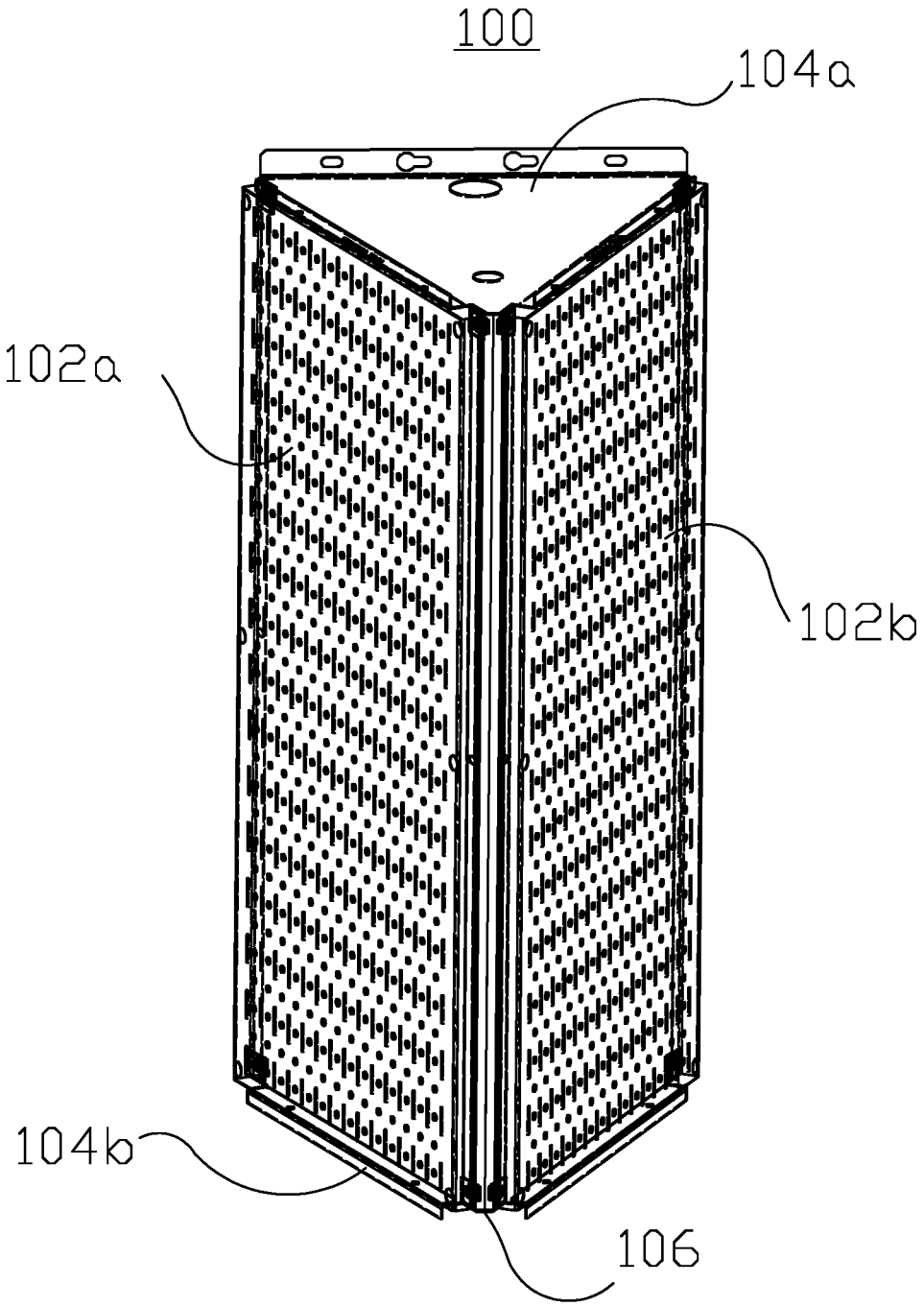
FIG. 1 is a top perspective view of a perforated-panel three-dimensional wall mounting system.
Figure 2:
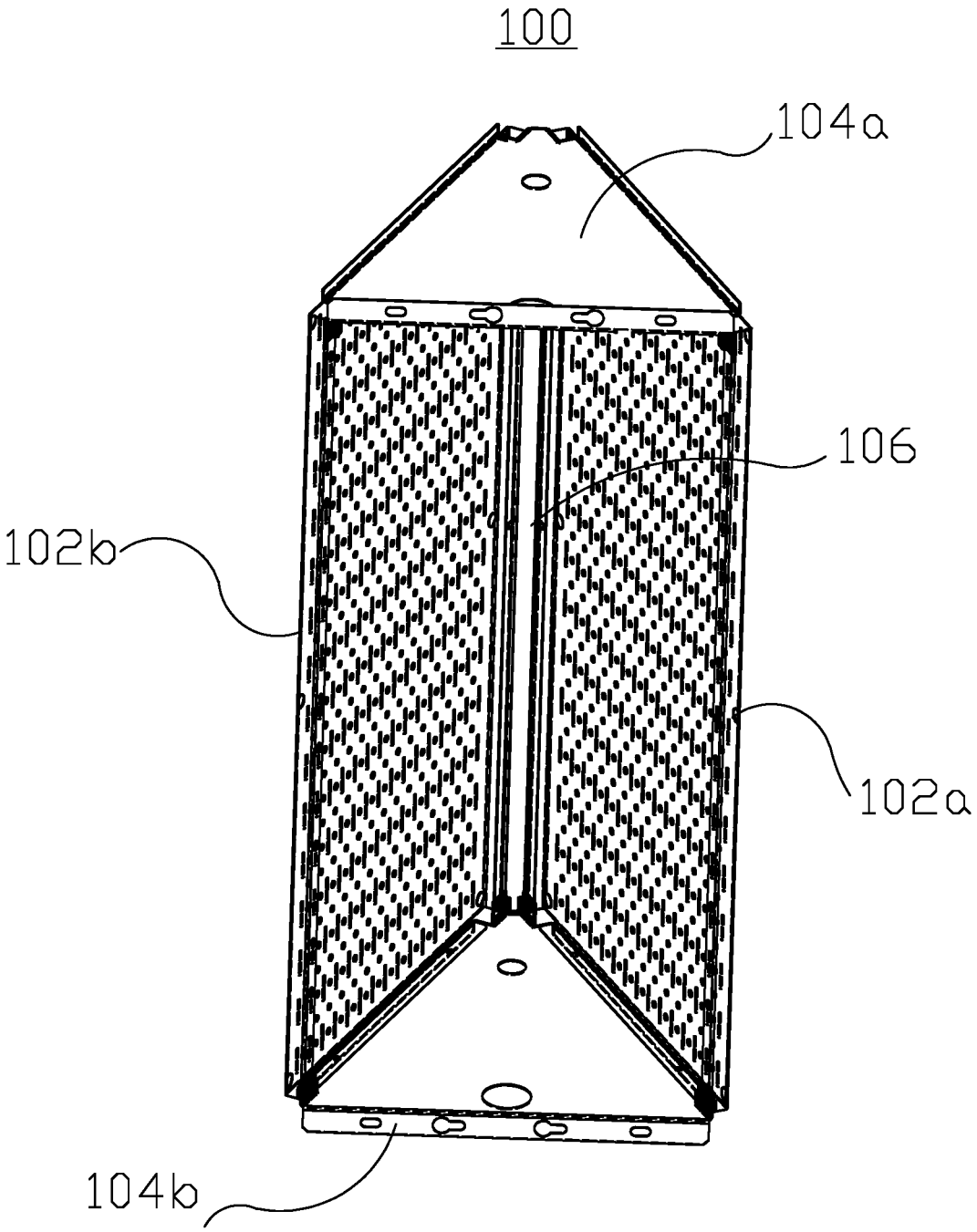
FIG. 2 is a bottom perspective view of the perforated-panel three-dimensional wall mounting system.
Figure 3:
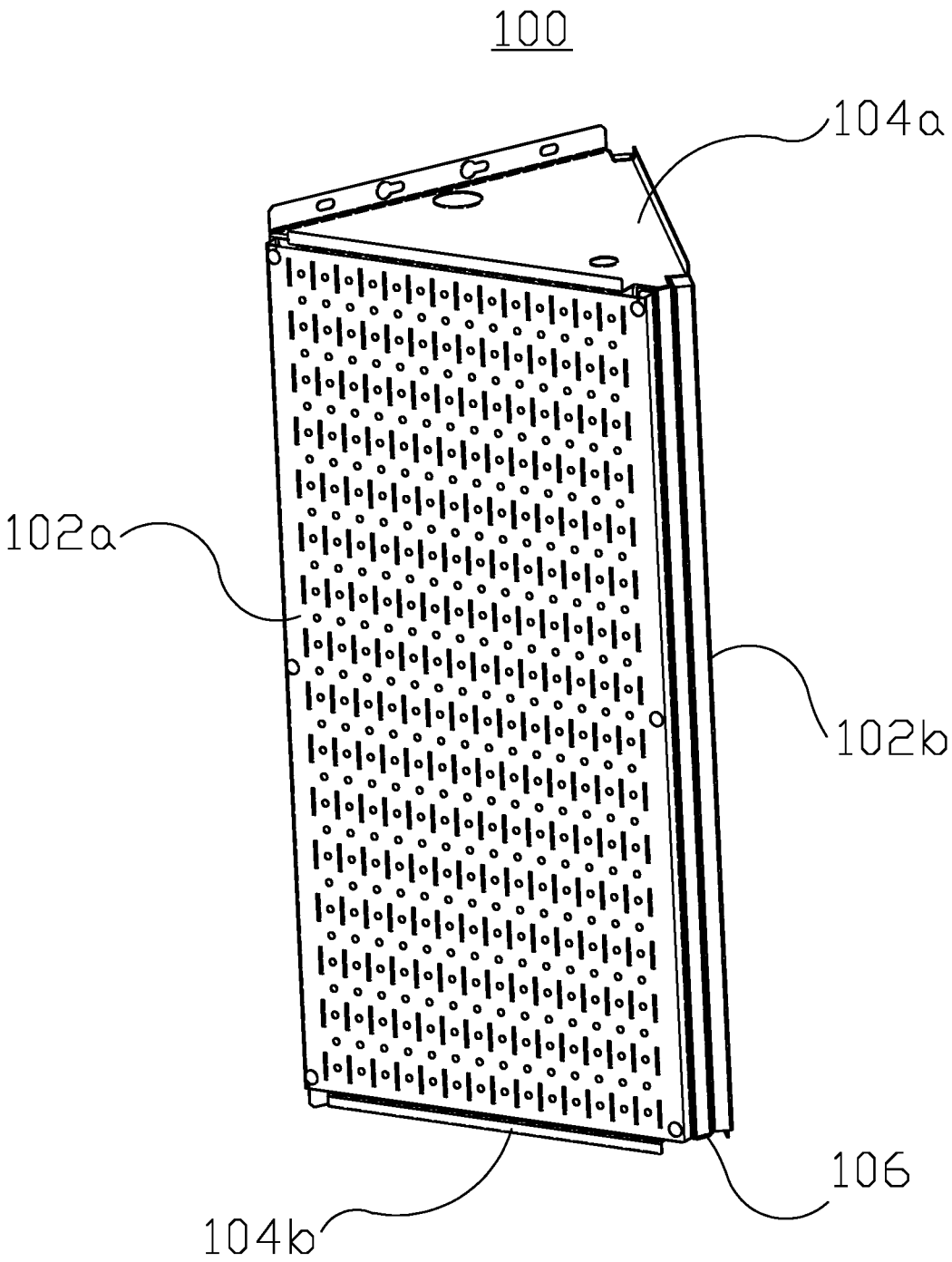
FIG. 3 is a side perspective view of the perforated-panel three-dimensional wall mounting system.
Figure 4:
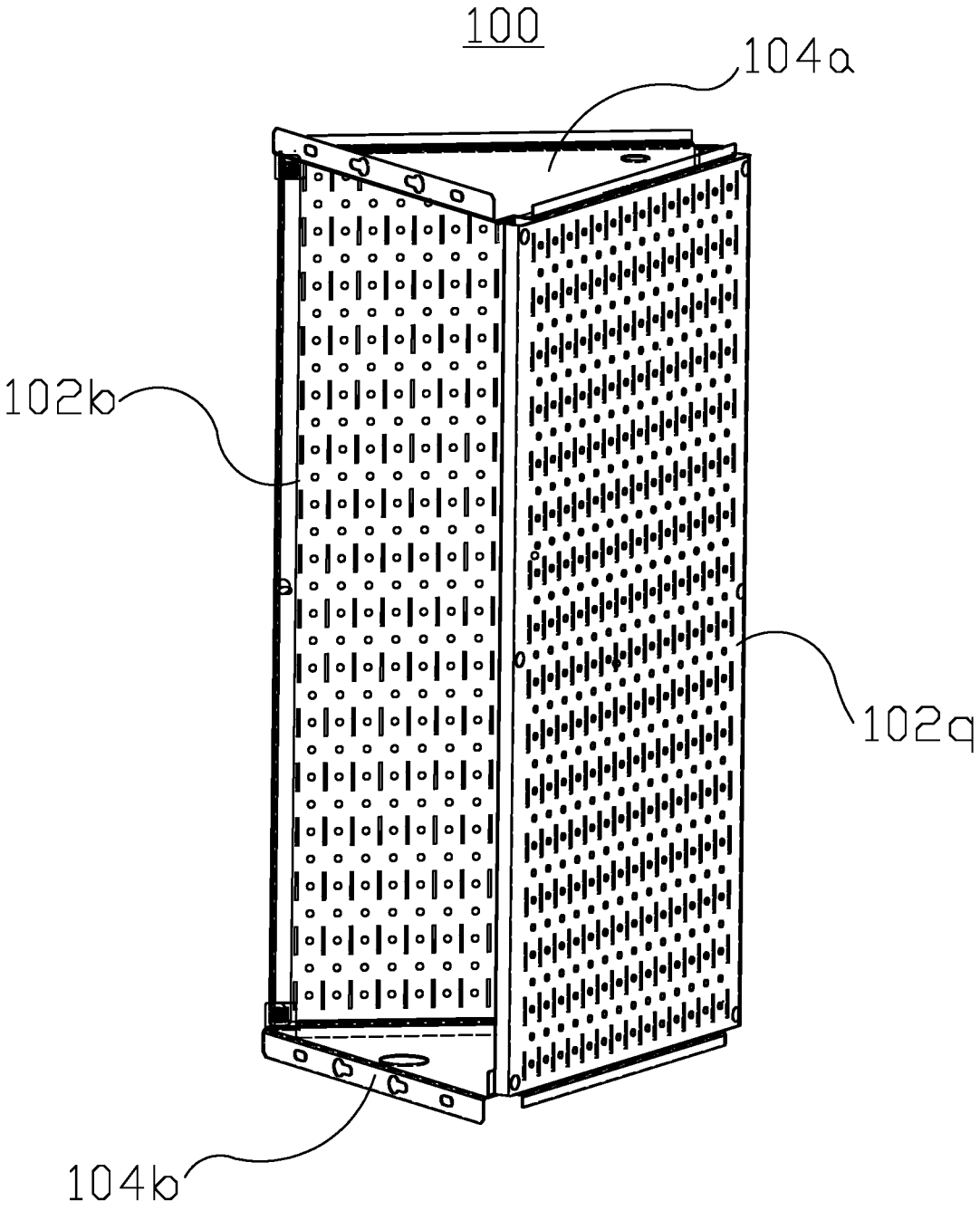
FIG. 4 is a rear perspective view of the perforated-panel three-dimensional wall mounting system.

FIGS. 1-4 illustrate a perforated-panel three-dimensional wall mounting system 100 according to certain examples. FIG. 1 is a top perspective view of a perforated-panel three-dimensional wall mounting system 100. FIG. 2 is a bottom perspective view of the perforated-panel three-dimensional wall mounting system 100. FIG. 3 is a side perspective view of the perforated-panel three-dimensional wall mounting system 100. FIG. 4 is a rear perspective view of the perforated-panel three-dimensional wall mounting system 100.

As shown in FIGS. 1-4, the perforated-panel three-dimensional wall mounting system 100 includes first and second perforated wall mounting panels 102*a*, 102*b* connected to top and bottom mounting brackets 104*a*, 104*b*. Then, the system 100 can be attached to a wall, work bench, cabinet, or other surface by attaching the top and/or bottom mounting brackets 104*a*, 104*b* to the surface. As shown in FIGS. 1-4, the panels 102*a*, 102*b* include various slots, holes, or other apertures therein to receive storage brackets, such as brackets, hooks, trays, shelves, or other storage components.

The panels 102*a*, 102*b* can be attached to the mounting brackets 104*a*, 104*b* via any suitable fastener. For examples, the panels 102*a*, 102*b* can be bolted, screwed, glued, mated, or otherwise attached to the mounting brackets 104*a*, 104*b*. To mate the panels 102*a*, 102*b* to the mounting brackets 104*a*, 104*b*, the panels 102*a*, 102*b* and the mounting brackets 104*a*, 104*b* can comprise corresponding slots and tabs, or other suitable retaining features, that mate together.

The mounting brackets 104*a*, 104*b* can be attached to the wall, work bench, or other surface via any suitable method, such as using bolts, screws, or any other suitable wall attachment (for example, molly bolts). The mounting brackets 104*a*, 104*b* and the mounting surface also can comprise corresponding slots and tabs, or other suitable retaining features, that mate together.

The panels 102*a*, 102*b* can be any suitable perforated wall mounting panel. For example, the panels 102*a*, 102*b* can be conventional or custom panels of any desired size, configuration, shape, or manufacturer. While panels 102*a*, 102*b* are conventionally mounted flat against a surface, attaching the panels 102*a*, 102*b* to the mounting brackets 104*a*, 104*b* configures the panels 102*a*, 102*b* to extend outwardly from the surface to which the system 100 is mounted. In this manner, the three-dimensional wall mounting system 100 provides additional panel surface area utilizing a smaller mounting surface area (for example, the wall surface area). The panels 102*a*, 102*b* can include L-shaped flanges or other extension around at least one side of the perimeter of the panel, which facilitates mounting the panel surface in a spaced position from a mounting surface (such as a wall) to which the panel is attached in a conventional system. Such panels 102*a*, 102*b* also can be used in the three-dimensional wall mounting system 100 described herein. Additionally, the configuration of the three-dimensional wall mounting system 100 positions the panels 102*a*, 102*b* away from the mounting surface. Accordingly, panels 102*a*, 102*b* having a planar surface without the extensions around a portion of the perimeter also are suitable for use in the three-dimensional wall mounting system 100.

If desired, a spacer 106 may be attached between the front edge of the panels 102*a*, 102*b* to fill any gap existing between the panels 102*a*, 102*b*. The spacer 106 can be attached to edges of the panels 102*a*, 102*b* and/or to the mounting brackets 104*a*, 104*b* using any suitable fastener, such as screws, bolts, glue, mating surfaces, or other suitable fastener.

Figure 5:
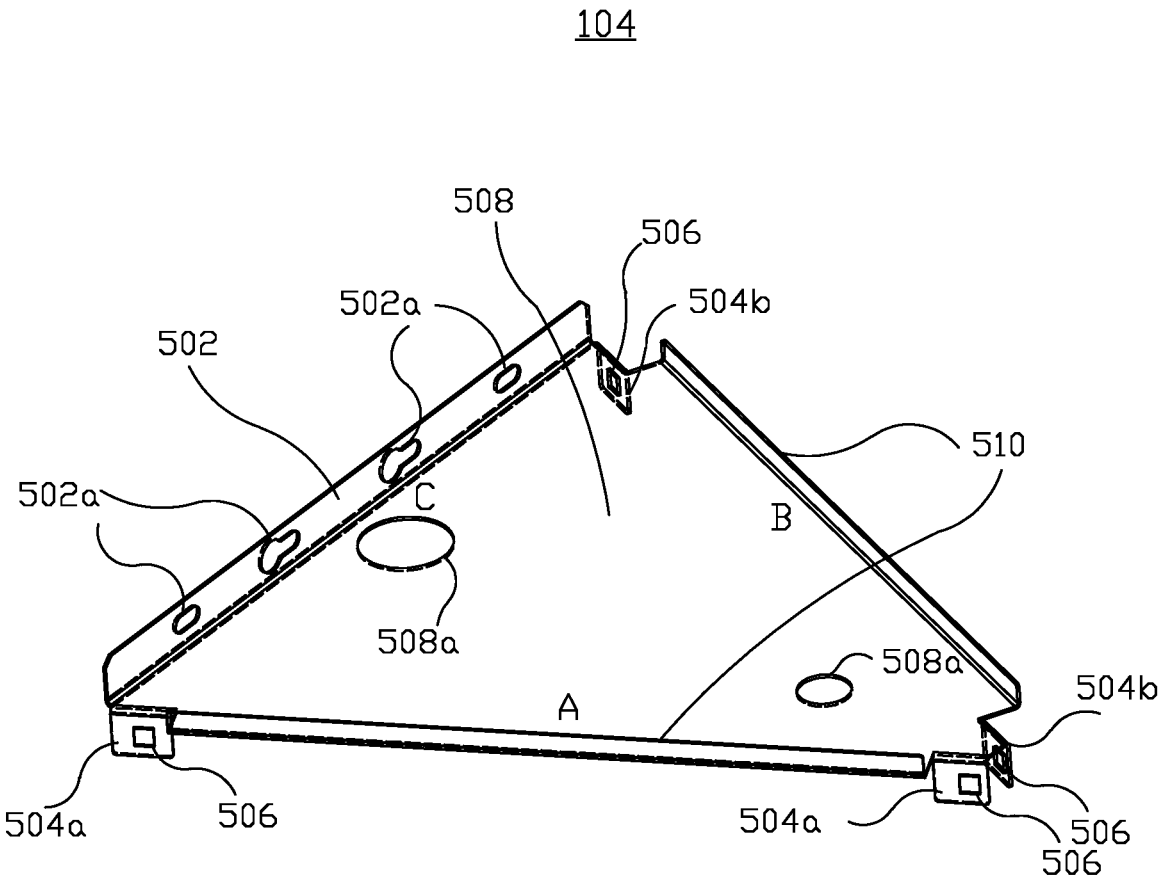
FIG. 5 is a perspective view of a mounting bracket for the top and/or the bottom mounting brackets of the perforated-panel three-dimensional wall mounting system.

FIG. 5 is a perspective view of a mounting bracket 104 suitable for the top and/or the bottom mounting brackets 104*a*, 104*b* of the three-dimensional wall mounting system 100, according to certain examples. The exemplary mounting bracket 104 is shaped in the form of a triangle with a first panel side A, a second panel side B, and a surface mounting side C.

The surface mounting side C of the mounting bracket 104 comprises a surface mounting flange 502 is oriented to mate flush with the desired mounting surface. The surface mounting flange 502 includes holes 502*a* therethrough to facilitate mounting the bracket 104 (and the system 100) to a surface, such as a wall, cabinet, workbench, or other surface. Bolts, screws, or other fasteners are inserted through the holes 502*a* of the surface mounting flange 502 and attached to the surface to anchor the mounting bracket 104 (and the system 100) to the surface. Alternatively, the surface mounting flange 502 and the surface can comprise corresponding slots and tabs, or other suitable retaining features, that mate together to secure the mounting bracket 104 to the surface.

Each panel side A, B of the mounting bracket 104 includes panel mounting flanges 504*a*, 504*b* to which the panels 102*a*, 102*b* are attached. The panel mounting flanges 504*a*, 504*b* are oriented to mate with a backside of each panel 102*a*, 102*b* (FIGS. 1-4). The panel mounting flanges 504*a*, 504*b* include holes 506 therethrough to facilitate mounting the panels 102*a*, 102*b* to the mounting bracket 104. Bolts, screws, or other fasteners are inserted through the holes 506 of the panel mounting flanges 504*a*, 504*b* and attached to the panels 102*a*, 102*b* (FIGS. 1-4) to anchor the panels 102*a*, 102*b* to the mounting bracket 104.

The mounting bracket 104 also includes a shelf 508 corresponding to the surface connecting the surface mounting flange 502 to each panel side A, B. Edges 510 of the shelf 508 may be turned in the same direction as the panel mounting flanges 504*a*, 504*b* to provide an edge that helps keep items on the shelf 508. The shelf 508 also may include holes 508*a* or other apertures therein to facilitate item storage (such as tool storage).

The top and bottom brackets 104*a*, 104*b* depicted in FIGS. 1-4 may be the same type of bracket 104. For example, the bracket 104 depicted in FIG. 5 is oriented as a top bracket 104*a* as illustrated in FIGS. 1-4. The bracket 104 of FIG. 5 may be turned over to be used as a bottom bracket 104*b* as illustrated in FIGS. 1-4. If desired, one of the top or bottom brackets 104*a*, 104*b* may be omitted. For example, only the top bracket may be utilized, or only the bottom bracket may be utilized.

The exemplary mounting bracket 104 illustrated in FIGS. 1-5 has a triangular shape. The lengths of the panel sides A, B determines how much panel storage area can be provided utilizing the surface area covered by the surface mounting side C of the system 100. Longer panel sides A, B allows attachment of wider panels 102*a*, 102*b*, thereby increasing the panel storage area for a given surface mounting side C length. Alternatively, shorter panel sides A, B allows attachment of narrower panels 102*a*, 102*b*, thereby decreasing the panel storage area for a given surface mounting side C length. Lengths of the panel sides A, B may be chosen to match the width of standard size panels 102*a*, 102*b* or may be customized for any desired panel width.

Any suitable configuration of the sides A, B, C of the mounting bracket 104 can be accommodated. For example, the panel sides A, B and the surface mounting side C may be equal in length. Alternatively, the panel sides A, B may be equal in length while the surface mounting side C is longer or shorter than the length of the panel sides A, B. The panel sides A, B may be equal in length to accommodate panels 102*a*, 102*b* of equal width. Alternatively, the panel sides A, B may have different lengths to accommodate panels 102*a*, 102*b* having different widths. This configuration reduces an amount that the system 100 extends away from the mounting surface while still providing additional storage surface area compared to the area of the mounting surface covered by the system 100.

When the length of the surface mounting side C is equal to the length of the panel sides A, B, the system 100 provides twice as much panel storage area compared to a single conventional panel mounted flat to a wall. When the length of the surface mounting side C is less than the length of the panel sides A, B, the system 100 provides more than twice as much panel storage area compared to a single conventional panel mounted flat to a wall. When the length of the surface mounting side C is more than the length of the panel sides A, B, the system 100 provides less than twice as much, but still more, panel storage area compared to a single conventional panel mounted flat to a wall. Any suitable configuration of the lengths of the sides A, B, C of the mounting bracket 104 can be chosen to provide a desired additional panel storage area and distance away from the surface to which the system 100 is mounted.

Although shown as a triangular shape in FIG. 5, any suitable shape of the mounting bracket 104 may be utilized. For example, the mounting bracket 104 may have a square, pentagonal, hexagonal, or any suitable multi-sided shape. In these cases, additional panels 102*a*, 102*b* are utilized for the additional panel sides.

The mounting bracket 104 is depicted in FIG. 5 as a substantially solid bracket, having various mounting and storage holes 508*a*. However, any suitable configuration for the mounting bracket 104 may be utilized. For example, the mounting bracket 104 may have a "framework" design, including the surface mounting flange 502 and the edges 510 connected to each other to form a triangular frame. In this case, the shelf 508 is not provided. The shelf 508 can be provided to accommodate additional storage or to provide additional structural strength, as desired. Additionally, although shown in FIG. 5 as being formed from a continuous piece of material, the mounting bracket 104 may be formed of independent parts that are bolted, welded, screwed, or otherwise suitably attached together.

The mounting bracket 104 may be formed of any suitable material, such as metal, plastic, composites, combinations thereof, or other suitable materials.

Figure 6:
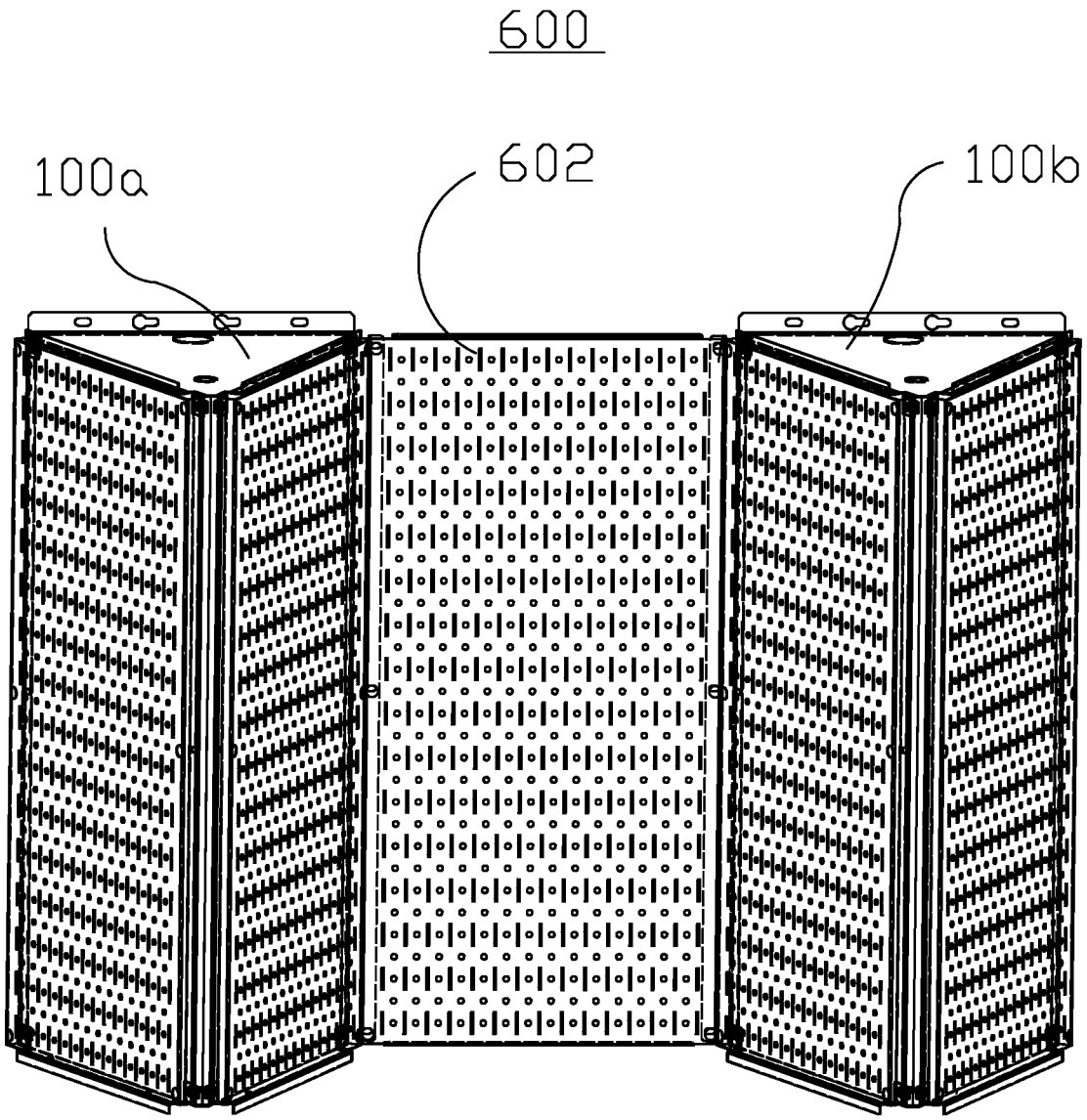
FIG. 6 is a front perspective view of an aggregated perforated-panel wall mounting system.

FIG. 6 is a front perspective view of an aggregated perforated-panel wall mounting system 600, according to certain examples. As shown in FIG. 6, the aggregated wall mounting system 600 includes two three-dimensional wall mounting systems 100*a*, 100*b* separated by a flat perforated panel 602. The aggregated system 600 can be assembled by attaching the panel 602 to each of the three-dimensional wall mounting systems 100*a*, 100*b*. Then, the aggregated system 600 can be attached to a wall or other surface by attaching the mounting brackets of the three-dimensional wall mounting systems 100*a*, 100*b* to the surface. Any desired configuration can be created for an aggregated system 600. For example, additional panels 602 may be added between or outside the three-dimensional wall mounting systems 100*a*, 100*b*. Additional three-dimensional wall mounting systems 100 also may be utilized, either directly next to each other and/or separated by panels 602. The aggregated system 600 also can be assembled by mounting the panel 602 to the wall or other surface and by attaching the three-dimensional wall mounting systems 100*a*, 100*b* to the wall or other surface on opposite sides of the panel 602.

The example systems and components described in the embodiments presented herein are illustrative, and, in alternative embodiments, certain components can be combined in a different order, omitted entirely, and/or combined between different example embodiments, and/or certain additional components can be added, without departing from the scope and spirit of various embodiments. Accordingly, such alternative embodiments are included in the scope of the following claims, which are to be accorded the broadest interpretation to encompass such alternate embodiments.

Although specific embodiments have been described above in detail, the description is merely for purposes of illustration. It should be appreciated, therefore, that many aspects described herein are not intended as required or essential elements unless explicitly stated otherwise. Modifications of, and equivalent components corresponding to, the disclosed aspects of the example embodiments, in addition to those described above, can be made by a person having ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. A three-dimensional perforated-panel wall mounting system, comprising:

a mounting bracket comprising at least a first side, a second side, and a third side, the first side being configured to attach the mounting bracket to a vertical surface of a wall by comprising a plurality of apertures therein that each receive a corresponding fastener to attach the mounting bracket to the wall;

a first perforated panel attached to the second side of the mounting bracket; and a second perforated panel attached to the third side of the mounting bracket, the first and second perforated panels being configured to receive a plurality of item-holding brackets, the first side of the mounting bracket comprising a vertical flange extending in a first direction away from the mounting bracket, at least a portion of the plurality of apertures being disposed in the vertically extending flange of the first side, the second side and the third side of the mounting bracket each comprising at least one vertical flange extending in a second direction away from the mounting bracket and to which the first and second perforated panels are attached, respectively, and the first direction being opposite to the second direction.

2. The wall mounting system according to claim 1, wherein the first side, the second side, and the third side of the mounting bracket are arranged to form a triangular shape.

3. The wall mounting system according to claim 1, wherein the first side, the second side, and the third side of the mounting bracket are equal in length.

4. The wall mounting system according to claim 1, wherein the mounting bracket comprises at least one additional side, wherein the first side, the second side, the third side, and each of the at least one additional side of the mounting bracket are arranged to form a shape other than a triangular shape.

5. The wall mounting system according to claim 1, the mounting bracket further comprising a horizontal shelf disposed between the first side, the second side, and the third side, the shelf comprising vertically extending edges extending linearly along at least the second side and the third side of the mounting bracket away from the shelf in a direction that is opposite to the second direction in which the vertically extending flanges of the second side and the third side of the mounting bracket extend away from the mounting bracket.

6. The wall mounting system according to claim 1, further comprising a second mounting bracket, the second mounting bracket comprising at least a first side, a second side, and a third side, the first side of the second mounting bracket being configured to attach the second mounting bracket to the surface, the first perforated panel being also attached to the second side of the second mounting bracket, and the second perforated panel being also attached to the third side of the second mounting bracket.

7. The wall mounting system according to claim 1, wherein the first perforated panel and the second perforated panel each comprise a plurality of apertures therein to receive the plurality of item-holding brackets.

8. The wall mounting system according to claim 7, wherein the plurality of apertures in the first perforated panel and the second perforated panel comprises at least one of slots and holes.

9. A mounting bracket for perforated-panel wall mounting systems, comprising:

a vertically extending flange portion along a first edge of the mounting bracket, the flange portion comprising at least one aperture therein;

a first perforated panel mounting portion disposed on a second edge of the mounting bracket, the first perforated panel mounting portion comprising at least one aperture therein;

a second perforated panel mounting portion disposed on a third edge of the mounting bracket, the second perforated panel mounting portion comprising at least one aperture therein; and a shelf portion disposed between at least the second and third edges of the mounting bracket, the shelf portion comprising vertical edges extending linearly along at least the first and second perforated panel mounting portions of the mounting bracket, the vertical edges of the shelf portion extending away from the mounting bracket in a direction that is opposite to a direction in which the first and second perforated panel mounting portions extend away from the mounting bracket.

10. The mounting bracket according to claim 9, the first perforated panel mounting portion comprising at least one vertically extending flange, at least a portion of the at least one aperture of the first perforated panel mounting portion being disposed in the vertically extending flange of the first perforated panel mounting portion, and the second perforated panel mounting portion comprising at least one vertically extending flange, at least a portion of the at least one aperture of the second perforated panel mounting portion being disposed in the vertically extending flange of the second perforated panel mounting portion.

11. The mounting bracket according to claim 9, the vertically extending flange portion along the first edge of the mounting bracket extending in a first direction away from the mounting bracket, the first and second perforated panel mounting portions each comprising at least one flange extending in a second direction away from the mounting bracket.

12. The mounting bracket according to claim 11, wherein the first direction and the second direction are opposite directions.

13. The mounting bracket according to claim 9, the vertically extending flange portion, the first panel mounting portion, the second panel mounting portion, and the shelf portion being integrally formed from a continuous piece of material.

14. An extended perforated-panel wall mounting system, comprising:

a first perforated-panel three-dimensional wall mounting system comprising a first mounting bracket comprising at least a first side, a second side, and a third side, the first side of the first mounting bracket being configured to attach the first mounting bracket to a vertical surface of a wall, a first perforated panel attached to the second side of the first mounting bracket, and a second perforated panel attached to the third side of the first mounting bracket, the first side of the first mounting bracket comprising a vertical flange extending in a first direction away from the first mounting bracket, the second side and the third side of the first mounting bracket each comprising at least one vertical flange extending in a second direction away from the first mounting bracket and to which the first and second perforated panels are attached, respectively, wherein the first direction is opposite to the second direction;

a second perforated-panel three-dimensional wall mounting system comprising a second mounting bracket comprising at least a first side, a second side, and a third side, the first side of the second mounting bracket being configured to attach the second mounting bracket to the vertical surface of the wall, a third perforated panel attached to the second side of the second mounting bracket, and a fourth perforated panel attached to the third side of the second mounting bracket, the first side of the second mounting bracket comprising a vertical flange extending in a third direction away from the second mounting bracket, the second side and the third side of the second mounting bracket each comprising at least one vertical flange extending in a fourth direction away from the second mounting bracket and to which the third and fourth perforated panels are attached, respectively, wherein the third direction is opposite to the fourth direction; and a fifth perforated panel coupled to the first perforated-panel three-dimensional wall mounting system and to the second perforated-panel three-dimensional wall mounting system.

15. The extended perforated-panel wall mounting system according to claim 14, a first edge of the fifth perforated panel being connected to the second perforated panel of the first perforated-panel three-dimensional wall mounting system, and a second edge of the fifth perforated panel being connected to the third perforated panel of the second perforated-panel three-dimensional wall mounting system.

16. The mounting bracket according to claim 9, each of the at least one aperture in the vertically extending flange portion along the first edge of the mounting bracket being configured to receive a corresponding fastener to attach the mounting bracket to a vertical surface of a wall.

* * * * *